US005967123A

United States Patent [19]

Ruoff et al.

[11] Patent Number: 5,967,123

[45] Date of Patent: Oct. 19, 1999

[54] FUEL PUMP

[75] Inventors: Manfred Ruoff, Moglingen; Helmut Rembold, Stuttgart; Hans-Peter Stiefel, Ditzingen; Gottlob Haag, Markgroningen; Karl Gmelin, Flein; Volkmar Goldschmitt, Asperg; Karlheinz Schmidtpeter, Neunkirchen-Speikern; Matthias Einecke, Rosstal; Uwe Mueller, Korntal-Munchingen, all of Germany

[73] Assignee: Robert Bosch GmbH, Stuttgart, Germany

[21] Appl. No.: 09/029,973

[22] PCT Filed: Apr. 18, 1997

[86] PCT No.: PCT/DE97/00777

§ 371 Date: Mar. 10, 1998

§ 102(e) Date: Mar. 10, 1998

[87] PCT Pub. No.: WO98/01673

PCT Pub. Date: Jan. 13, 1998

[30] Foreign Application Priority Data

Jul. 10, 1996 [DE] Germany ..... 196 27 757

[51] Int. Cl.[6] ..... F04B 1/04; F02M 37/04

[52] U.S. Cl. ..... 123/495

[58] Field of Search ..... 123/495; 417/434; 277/346, 353, 563, 558

[56] References Cited

U.S. PATENT DOCUMENTS 4,301,777 11/1981 Grundman ..... 123/495

FOREIGN PATENT DOCUMENTS

| | | |
|---|---|---|
| 0256389 | 2/1988 | European Pat. Off. . |
| 44 19 927 | 12/1995 | Germany . |
| 54-095827 | 7/1979 | Japan . |
| 62-045969 | 2/1987 | Japan . |
| 05223055 | 8/1993 | Japan . |
| 08042430 | 2/1996 | Japan . |

*Primary Examiner*—Thomas N. Moulis
*Attorney, Agent, or Firm*—Edwin E. Greigg; Ronald E. Greigg

[57] ABSTRACT

A piston pump for pumping fuel in which a risk of fuel getting into the area of a shaft seal is limited. The fuel pump includes a separation chamber which is provided between a shaft seal and a fuel chamber that contains fuel. Located in the separation chamber is for instance air as a separator means, and the separation chamber communicates with an air inlet of the engine. This assures that fuel cannot get into the area of the shaft seal or escape to the outside. The fuel pump is suitable in particular for internal combustion engines in which the fuel must be delivered at high pressure.

10 Claims, 4 Drawing Sheets

FUEL PUMP

PRIOR ART

The invention is based on a fuel pump for pumping fuel for an internal combustion engine.

In internal combustion engines, the fuel supplied to the engine increasingly has to be delivered to the engine at relatively high pressure. As a result, the drive mechanism used to drive the pump element is subjected to major mechanical forces. Especially in displacement pumps and particularly piston pumps and especially radial piston pumps, the load on the bearing that supports the drive mechanism is relatively great. In piston pumps, the drive mechanism is typically a rotationally supported shaft, and the bearing are severely loaded in the radial direction. Since the fuel has no lubricating property or only an extremely poor lubricating property but conversely can severely damage the bearing, the fuel must be prevented from getting into the region of the bearing. This is especially true when the fuel is gasoline.

The bearing is typically provided with a special lubricant. To prevent the lubricant from escaping from the bearing, a bearing seal is provided. The bearing seal must be adapted to the lubricant. If the fuel gets into the region of the bearing seal, then the fuel can deleteriously affect the properties of the bearing seal, especially when the fuel is gasoline.

In a known fuel pump (German Offenlegungsschrift DE 44 19 927 A1), the drive mechanism is a shaft rotationally supported via two ball bearings. In this fuel pump, external lubrication is provided. In the known fuel pump, lubricant is pressed between the two ball bearings via a lubricant delivery opening. This requires a separation lubricant source for supplying the lubricant. This increases the expense considerably. Moreover, the bearing seal used to seal off the ball bearing comes into contact with the fuel on one side, which shortens the service life of the bearing seal. Since the bearing seal cannot seal absolutely, at least very minimal quantities of fuel can always get into the region of the ball bearings, which impairs their durability.

Fuel must also be prevented from escaping to the outside from the housing between the drive mechanism and the housing. In the known fuel pumps, despite complicated and expensive sealing provisions, this problem has not been solved to satisfaction.

ADVANTAGES OF THE INVENTION

The fuel pump according to the invention for pumping fuel for an internal combustion engine has the advantage over the prior art that the fuel is excellently well separated from the bearing that supports the drive mechanism, which has a favorable effect on the durability of the bearing. An escape of the fuel from the fuel pump housing is advantageously reliably prevented even without complicated sealing provisions.

If the separator means is air, the result is advantageously a structurally simple feasibility of the fuel pump, and the communication of the separation chamber with the air supplied at least indirectly by the engine is especially simple.

For engine operation, air is needed, which is supplied by the engine, so that advantageously without major effort, at least a small portion of this air can be passed through the separation chamber.

If the separation chamber is made to communicate with the air inlet of the engine, this has the advantage that any fuel that might reach the separation chamber can be diverted without difficulty into the engine and combusted harmlessly.

In the air inlet, at least a slight negative pressure prevails at least intermittently, which promotes the aspiration of the fuel or fuel vapor out of the separation chamber.

If the separation chamber is additionally provided with an entrance through which air can get into the separation chamber, then thorough scavenging of the separation chamber with air is advantageously obtained.

Through the throttle restriction between the separation chamber and the air inlet of the engine, the pressure in the separation chamber and the quantity of air flowing through it can advantageously be varied.

The pressure in the separation chamber and the scavenging of the separation chamber with air can advantageously be varied by means of the throttle provided upstream of the entrance to the separation chamber.

Oil is advantageously especially well suited as a separator means. In internal combustion engines, a recirculating engine lubrication system is typically provided for supplying oil to various bearing points. With this recirculating engine lubrication system, advantageously, it is especially simple to pass oil through the separation chamber.

By means of the throttle between the separation chamber and the recirculating engine lubrication system, the pressure in the separation chamber, or the quantity of oil that is supplied through the separation chamber, can advantageously be varied without major effort.

BRIEF DESCRIPTION OF THE DRAWINGS

Selected, especially advantageous exemplary embodiments of the invention are shown in simplified form in the drawing and described in further detail below. Shown are FIG. 1, a longitudinal cross section through a fuel pump selected as an example.

DESCRIPTION OF THE EXEMPLARY EMBODIMENTS

The fuel pump is used to supply fuel required by an internal combustion engine. The fuel pump embodied according to the invention operates by the displacement principle, for instance. A fuel pump operating by the displacement principle typically has one or more pump elements. The pump element by way of example has a reciprocating piston or rotating displacement chambers that increase and decrease in size during the rotation. Depending on the disposition of the pump element or elements, a distinction can be made between an axial piston pump, oblique disk pump, swash pump, oblique shaft pump, radial piston pump, vane cell pump, etc., for instance. The pump element or elements are driven by a drive mechanism. By way of example, the drive mechanism is a reciprocating rod or a rotationally supported shaft. The fuel pump has a low-pressure side and a high-pressure side. The at least one pump element pumps fuel from the low-pressure side to the high-pressure side.

The fuel pump embodied according to the invention is especially well-suited to internal combustion engines of the kind in which the fuel must be pumped at high pressure.

The fuel by way of example is Diesel oil or gasoline. If the fuel is gasoline, then the particular advantages of the fuel pump embodied according to the invention make themselves felt especially advantageously, because gasoline, were it to get into the area of the bearings, can deleteriously affect the materials of the bearing and of the seal for sealing off the bearing.

For the preferred exemplary embodiment described below, for the sake of simplicity, a fuel pump that operates on the principle of a radial piston pump, has a unilaterally rotationally supported shaft as its drive mechanism, and for pumping the fuel three pump elements have been selected. The preferably selected fuel pump has a so-called floating bearing of the drive mechanism. It should be pointed out that in a modification of the exemplary embodiment shown, the drive mechanism embodied in the form of a rotationally supported shaft may also be supported on both sides of the three pump elements.

Figure 1:
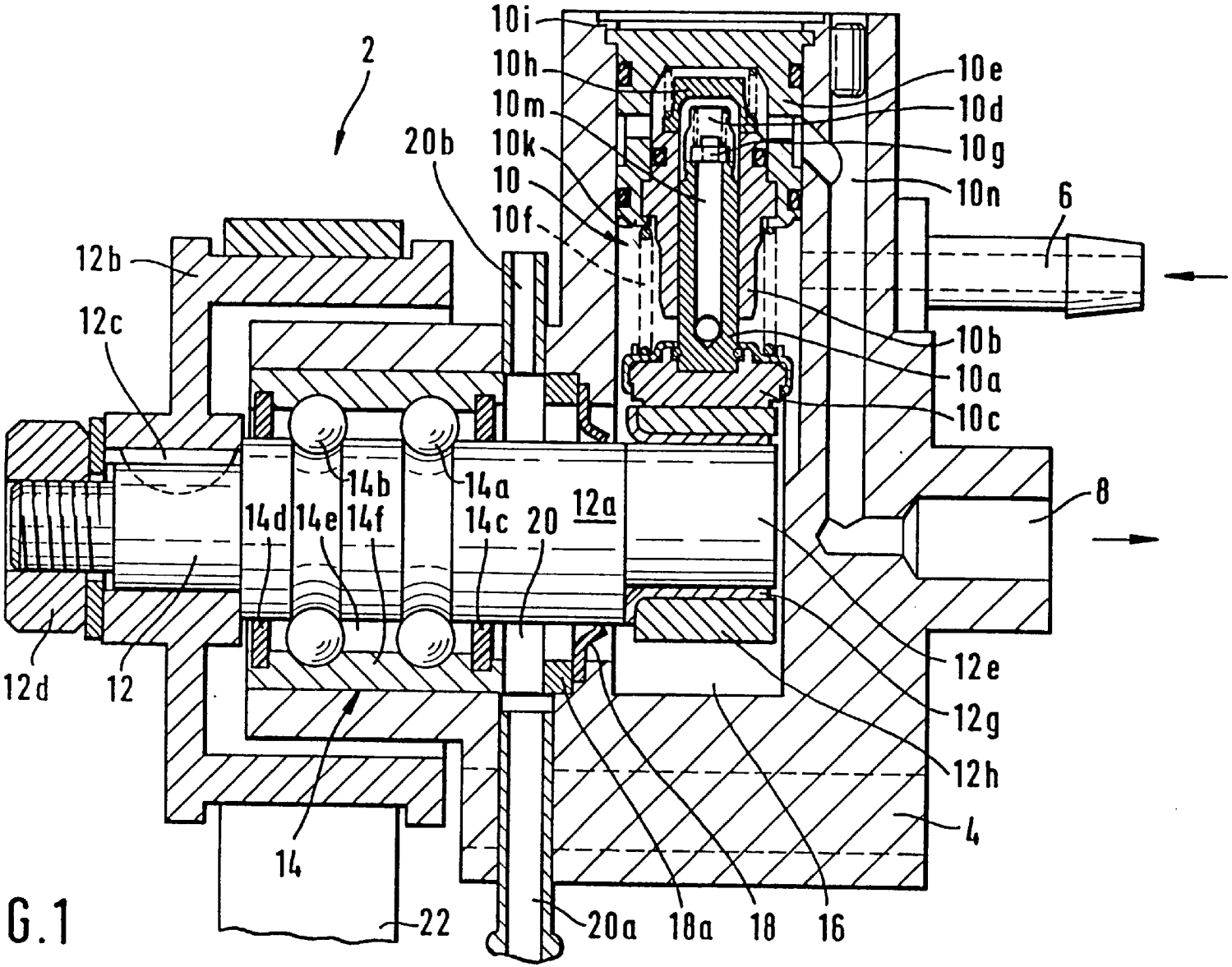

FIG. 1 by way of example shows a sectional plane of a longitudinal section through a preferably selected fuel pump 2 embodied according to the invention. The fuel pump 2 selected as an example has three pump elements; in the sectional plane shown, one of the three pump elements is visible, and the other two pump elements are located below and above the sectional plane shown, respectively.

The fuel pump 2 substantially includes a housing 4, a low-pressure connection 6, a high-pressure connection 8, a pump element 10, a drive mechanism 12, a bearing 14, a fuel chamber 16, a seal 18, and a separation chamber 20.

The drive mechanism 12 substantially includes a shaft 12*a*, a pulley 12*b*, a rotational coupler 12*c*, a securing means 12*d*, an eccentric shaft segment 12*e*, a sliding disk 12*g*, and a reciprocating piece 12*h*.

The shaft 12*a* of the drive mechanism 12 is rotatably supported in the housing 4 with the aid of the bearing 14. On a part of the shaft 12*a* protruding out of the housing 4, the pulley 12*b* is connected in a manner fixed against relative rotation with the aid of the rotational coupler 12*c*. By way of example, the rotational coupler 12*c*includes a spine, which engages one groove each provided in a shaft 12*a* and in the pulley 12*b*. The securing means 12*d* by way of example is a nut that holds the pulley 12*b* on the shaft 12*a*. The pulley 12*b* is connected with regard to driving with an internal combustion engine 24 (FIG. 2) via a belt 22. The engine 24, via the belt 22, rotates the shaft 12*a* of the drive mechanism 12 in the housing 4.

In the preferably selected exemplary embodiment, the bearing 14 substantially includes a first roller bearing 14*a*, a second roller bearing 14*b*, a first bearing seal 14*c*, a second bearing seal 14*d*, a bearing chamber 14*e*, and a bearing shell 14*f*. In a modification of the exemplary embodiment shown, instead of the roller bearings 14*a*, 14*b* the bearing 14 may include a slide bearing, for instance.

The roller bearings 14*a*, 14*b* serve the purpose of radial support of the shaft 12*a* and by way of example include balls, supported on one side on the shaft 12*a* and on the other on the bearing shell 14*f*. To improve the bearing 14, encompassing grooves are provided in the shaft 12*a*, and the balls of the roller bearings 14*a*, 14*b* are guided in these grooves. Via these encompassing grooves, an axial bearing of the shaft 12*a* is additionally possible. The bearing shell 14*f* is additionally pressed firmly on its outer circumference into the housing 4.

As the exemplary embodiment shows, the bearing chamber 14*e* is a hollow space between the shaft 12*a*, the bearing shell 14*f*, and the bearing seals 14*c*, 14*d*. The first bearing seal 14*c* assures sealing off of the bearing chamber 14*e* from the separation chamber 20. The second bearing seal 14*d* seals off the bearing chamber 14*e* from the outside. Grease for lubricating the roller bearings 14*a*, 14*b* is located in the bearing chamber 14*e*, and as a result, the durability of the bearing 14 can be improved substantially, despite relatively major transverse forces that must be transmitted between the shaft 12*a* and the housing 4 via the bearing 14.

The eccentric shaft segment 12*e* is provided on the shaft 12*a*, eccentrically to the pivot axis of the shaft 12*a*. Disposed on the eccentric shaft segment 12*e* is the sliding disk 12*g*, on which the reciprocating piece 12*h* is supported. A rotary motion of the shaft 12*a* leads to a reciprocating motion of the reciprocating piece 12*h* transversely to the pivot axis of the shaft 12*a*. The reciprocating motion of the reciprocating piece 12*h* is transmitted to the pump element 10.

The preferably selected pump element 10 shown as an example includes essentially a piston 10*a*, a piston guide 10*b*, a slide block 10*c*, a pressure chamber 10*d*, a retaining cartridge 10*e*, a spring 10*f*, a low-pressure valve 10*g*, and a high-pressure valve 10*h*.

The retaining cartridge 10*e* is retained in the housing 4 via a crimp 10*i*. A further crimp 10*k* holds the piston guide 10*b* firmly in the retaining cartridge 10*e*. The piston 10*a* is supported displaceably in the piston guide 10*b*. The piston 10*a* has a face end toward the reciprocating piece 12*h*. On the face end of the piston 10*a* toward the reciprocating piece 12*h*, the sliding block 10*c* is secured. The spring 10*f* is fastened between the retaining cartridge 10*e* and the sliding block 10*c*. The spring 10*f* presses the sliding block 10*c* against the reciprocating piece 12*h*. During an outward motion of the piston 10*a*, the spring 10*f* keeps the sliding block 10*c* in contact with the reciprocating piece 12*h*.

The low pressure connection 6 communicates with the fuel chamber 16 via a conduit extending in the housing 4. There is a longitudinal bore 10*m* in the piston 10*a*. The bore 10*m* communicates with the fuel chamber 16 via a transverse bore extending crosswise through the piston 10*a*. The pressure chamber 10*d* is located inside the retaining cartridge 10*e*. From the fuel chamber 16, the fuel passes through the bore 10*m*, through the low pressure valve 10*g*, into the pressure chamber 10*d*. The low pressure valve 10*g* is a check valve, which allows a flow of fuel out of the fuel chamber 16 into the pressure chamber 10*d* but prevents a flow of the fuel in the opposite direction. From the pressure chamber 10*d*, the fuel passes through the high pressure valve 10*h*, through conduits 10*n* extending at an angle and provided in the housing 4, to the high pressure connection 8. The high pressure valve 10*h* allows a flow of fuel out of the pressure chamber 10*d* in the direction of the high pressure connection 8, but a flow in the opposite direction is prevented by the high pressure valve 10*h*.

In accordance with the reciprocating motions of the reciprocating piece 12*h*, the piston 10*a* executes inward strokes and outward strokes. In an outward stroke, fuel passes out of the fuel chamber 16 through the low pressure valve 10*g* to reach the pressure chamber 10*d*. In an inward stroke of the piston 10*a*, the fuel is positively displaced out of the pressure chamber 10*d*, and passes under pressure through the high pressure valve 10*h* and the conduits 10*n* to reach the high pressure connection 8.

The fuel comes from a fuel tank 26 (FIG. 2) through the low pressure connection 6 to reach the fuel chamber 16 (FIG. 1). Between the fuel tank 26 and the fuel pump 2, a prefeed pump, not shown, may be provided. If there is no prefeed pump, then a pressure that is approximately equivalent to atmospheric pressure prevails in the fuel chamber 16. With the prefeed pump, the pressure in the fuel chamber 16 is higher than atmospheric pressure.

The seal 18 provides sealing between the separation chamber 20 and the fuel chamber 16. A ring 18*a* is press-fitted into the housing 4 and firmly holds the seal 18 in the housing 4. The seal 18 in the exemplary embodiment shown is an encompassing lip seal. The seal 18 may also for example be a slot ring, an O ring, a square ring, or other slide ring seal. The seal 18 is preferably embodied such that upon rotation of the shaft 12*a*, the least possible friction ensues between the seal 18 and the shaft 12*a*. The seal 18 is intended to prevent fuel from the fuel chamber 16 from reaching the separation chamber 20. In the opposite direction the seal 18 need not provide sealing. For this reason and because of the only slight friction desired, the lip seal shown in the drawing is especially expedient because any slight leakage of fuel from the fuel chamber 16 into the separation chamber 20 impedes the functioning of neither the fuel pump 2 nor the engine 24, only a very slight contact pressure of the seal 18 against the shaft 12*a* suffices. Because of the reduction of friction and because of the heat dissipation, the slight leakage of fuel from the fuel chamber 16 into the separation chamber 20 is in fact favorable for the durability of the seal 18. In a modification of the exemplary embodiment shown, the seal may for instance be firmly joined to the shaft of the drive mechanism and can slide along a bore wall in the housing.

In the preferably selected exemplary embodiment shown in FIG. 1, the separation chamber 20 can be connected via a first connection 20*a* and via a second connection 20*b*. The connections 20*a*, 20*b* lead out of the region of the separation chamber 20 to the outside through the housing 4.

In the drawing, the separation chamber 20 is shown as relatively large, for the sake of clarity, in the axial and radial directions. It will be noted that in the axial direction (the direction of the pivot axis of the shaft 12*a*) and in the radiation direction (perpendicular to the pivot axis of the shaft 12*a*), the separation chamber 20 may be made fairly small, so that the structural size of the fuel pump 2 is increased hardly at all or only insignificantly by the separation chamber 20.

Figure 2:
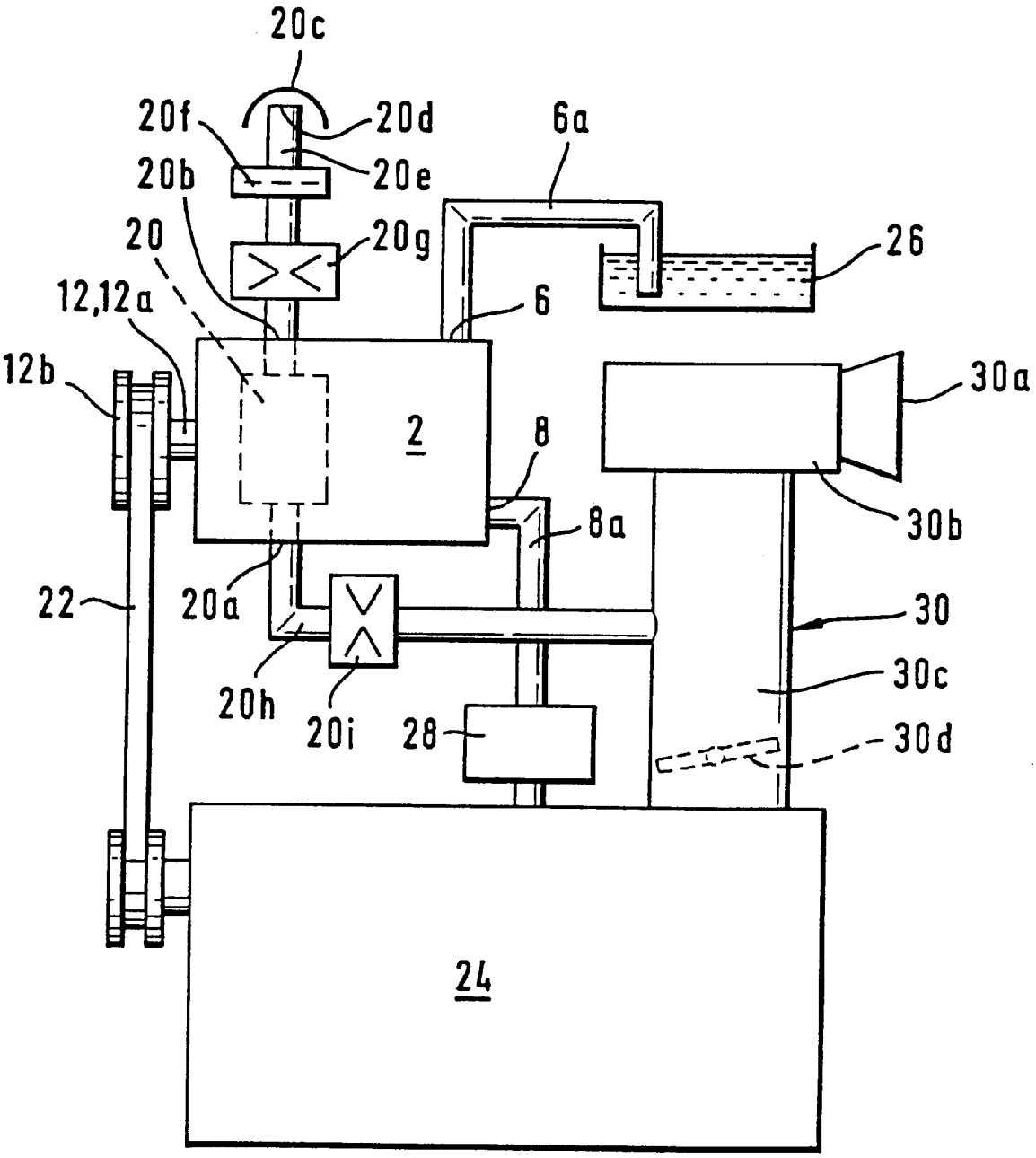
FIGS. 2–4, in symbolic form, various preferably selected exemplary embodiments for connecting the separation chamber.

FIG. 2 shows a highly simplified, schematic, symbolic side view of the fuel pump 2. In this side view, the separation chamber 20 is not visible and is therefore represented symbolically by dashed lines in FIG. 2.

In all the drawing figures, identical parts or parts with an identical function are identified by the same reference numerals. Unless otherwise mentioned or shown in the drawing, what is said and shown for one of the drawings figures applies to the other exemplary embodiments as well. Unless otherwise stated in the description, the details of the various exemplary embodiments can be combined with one another.

As FIG. 2 shows, a low pressure line 6*a* leads from the fuel tank 26 to the low pressure connection 6 of the fuel pump 2. From the high pressure connection 8, a high pressure line 8*a* leads to a fuel metering device 28. By way of example, the fuel metering device 28 includes a fuel collecting tube and a fuel injection valve or a plurality of fuel injection valves. Via the fuel injection valves of the fuel metering device 28, the fuel is metered to combustion chambers, not visibly shown in the drawing, of the engine 24.

The engine 24 selected as an exemplary for the exemplary embodiment has an air inlet 30. The air inlet 30 for instance includes an air inlet point 30*a*, an air filter 30*b*, an intake tube 30*c*, and a throttle 30*d*.

FIG. 2 also shows a cover 20*c*, an opening 20*d*, a line 20*e*, a filter screen 20*f*, a throttle restriction 20*g*, a line 20*h*, and a throttle restriction 20*i*. The line 20*e* leads from the opening 20*d* into the separation chamber 20, through the filter screen 20*f*, the throttle restriction 20*g*, and the connection 20*b*. The line 20*h* leads out of the separation chamber 20 to the air inlet 30 through the connection 20*a* and the throttle restriction 20*i*. The line 20*h* is connected to the interior of the intake tube 30*c* between the air filter 30*b* and the throttle 30*d*.

The cover 20*c* is provided so that splashing water and dirt will not get into the separation chamber 20. Depending on the vulnerability of the engine 24 and on the quality of the ambient air, the filter screen 20*f* and/or the cover 20*c* may optionally be omitted. With the throttle restriction 20*g*, the quantity of air flowing out of the environment into the separation chamber 20 can be varied. For the sake of greater clarity, in FIG. 2 the cover 20*c*, filter 20*f* and throttle restriction 20*g* are shown as separate components provided along the course of the line 20*e*. It will be noted that the throttle restriction 20*g* may also be made by suitable dimensioning of the bore forming the connection 20*b* or of the line 20*e*, and the filter 20*f* can be integrated directly into the connection 20*c*, as can the cover 20*b*. As a result, considerable installation space and expense can be saved.

Via the throttle restriction 20*i* provided in the line 20*h*, the quantity of air flowing through the separation chamber 20 can be varied. The throttle restriction 20*i* can for instance be integrated into the connection 20*a* by suitable dimensioning of the bore forming the connection 20*a*, or the throttle restriction 20*i* can be obtained in a desired way by making the inside cross section of the line 20*h* suitably small.

Depending on the position of the throttle 30*d* and on the rpm of the engine 24, more or less air flows through the air filter 30*b* and the intake tube 30*c* into the engine 24. Depending on the quantity of the air flowing through the air filter 30*b*, a pressure drop occurs in the air filter 30*b* and hence a negative pressure in the intake tube 30*c* downstream of the air filter 30*b*. Because of this negative pressure, air flows through the opening 20*d*, the line 20*e*, the throttle restriction 20*g*, the separation chamber 20, the line 20*h*, and the throttle restriction 20*i* into the intake tube 30*c* of the air inlet 30. By way of the dimensioning of the throttle restrictions 20*g* and 20*i*, the quantity of the air flowing through the separation chamber 20 and the pressure in the separation chamber 20 can both be varied. If the throttle restriction 20*g* provided upstream of the separation chamber 20 is made relatively small, that is, if the throttle restriction 20*g* has a relatively small inside diameter, and if in comparison to it the throttle restriction 20*i* provided downstream of the separation chamber 20 is made relatively large, then a relatively low pressure (that is, a relatively pronounced negative pressure) prevails in the separation chamber 20, and this pressure may optionally be nearly as low as the negative pressure in the intake tube 30*c*. As a result it can be achieved that the fuel leaking out of the fuel chamber 16 (FIG. 1) into the separation chamber 20 evaporates as fast as possible in the separation chamber 20 and is aspirated into the engine 24 via the air inlet 30. Via the line 20*e*, replenishing fresh air from outside can then flow constantly into the separation chamber 20. By making the throttle restriction 20*g* suitably larger, it can be attained that the pressure in the separation chamber 20 is reduced less markedly. Tight dimensioning of the throttle restriction 20*i* also has the result that the pressure in the separation chamber 20 drops only slightly, and that only little air flows through the separation chamber 20 into the air inlet 30.

In the preferably selected exemplary embodiment, the line 20*h* extends between the air filter 30*b* and the throttle 30*d* into the intake tube 30*c*. The exemplary embodiments shown may also be modified such that the line 20*h* between the throttle 30*d* and the combustion chambers of the engine 24 discharges into the intake tube 30*c*. However, in that case the pressure in the separation chamber 20 is rather markedly dependent on the position of the throttle 30*d*, and even if the throttle 30*d* is fully closed, air still enters the air inlet 30, which is not desirable for all engines.

Figure 3:
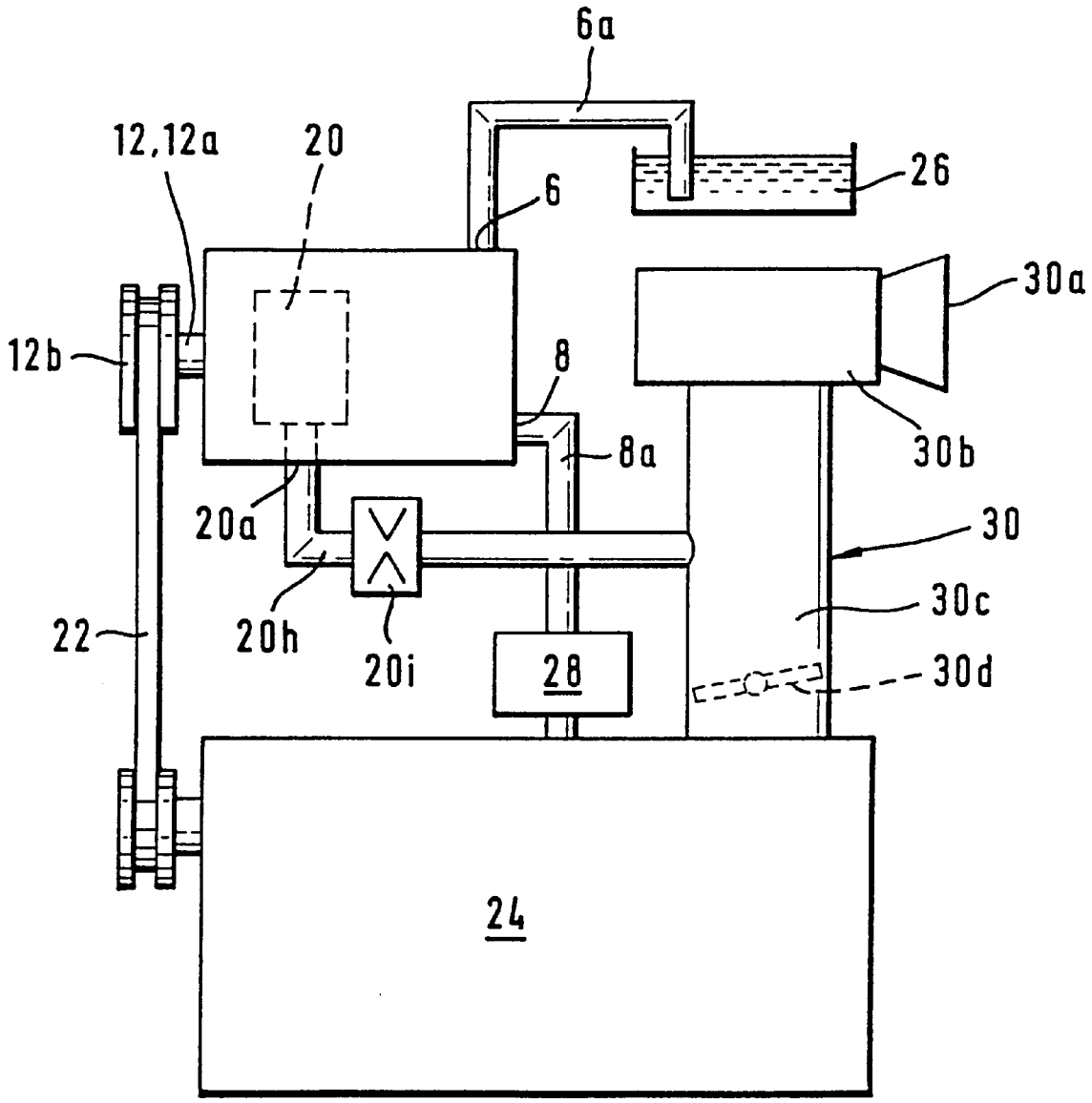

FIG. 3 shows a likewise schematic view of a further exemplary embodiment.

In the exemplary embodiment shown in FIG. 3, the cover 20*c*, the opening 20*d*, the line 20*e*, the filter screen 20*f*, the throttle restriction 20*g*, and the second connection 20*b* discharging into the separation chamber 20, all shown in FIG. 2, are omitted. In the exemplary embodiment shown in FIG. 3, the separation chamber 20 is connected to the air inlet 30 only via the connection 20*a*, the line 20*h*, and the more or less markedly throttling throttle restriction 20*i*. Small inside diameters suffice for the connection 20*a* and the line 20*h*. This automatically creates the throttle restriction 20*i*. In principle, the throttle restriction 20*i* may be omitted.

By connecting the separation chamber 20 to the air inlet 30, a pressure reduction is brought about in the separation chamber 20, and as a result the fuel leaking out of the fuel chamber 16 into the separation chamber 20 via the seal 18 is aspirated away into the air inlet 30.

The exemplary embodiment shown in FIG. 3 has the advantage that no impeding air can reach the air inlet 30 via the separation chamber 20. Therefore the line 20*h* can also discharge into the intake tube 30*c* between the dk 30*d* and the combustion chambers of the engine 24, without thereby delivering undesired air to the engine 24 when the dk 30*d* is closed.

Connecting the separation chamber 20 to the air inlet 30 brings about the advantage that the fuel that might leak out of the fuel chamber 16 into the separation chamber 20 cannot escape into the environment but rather reaches the engine 24, where it can be combusted properly.

Figure 4:
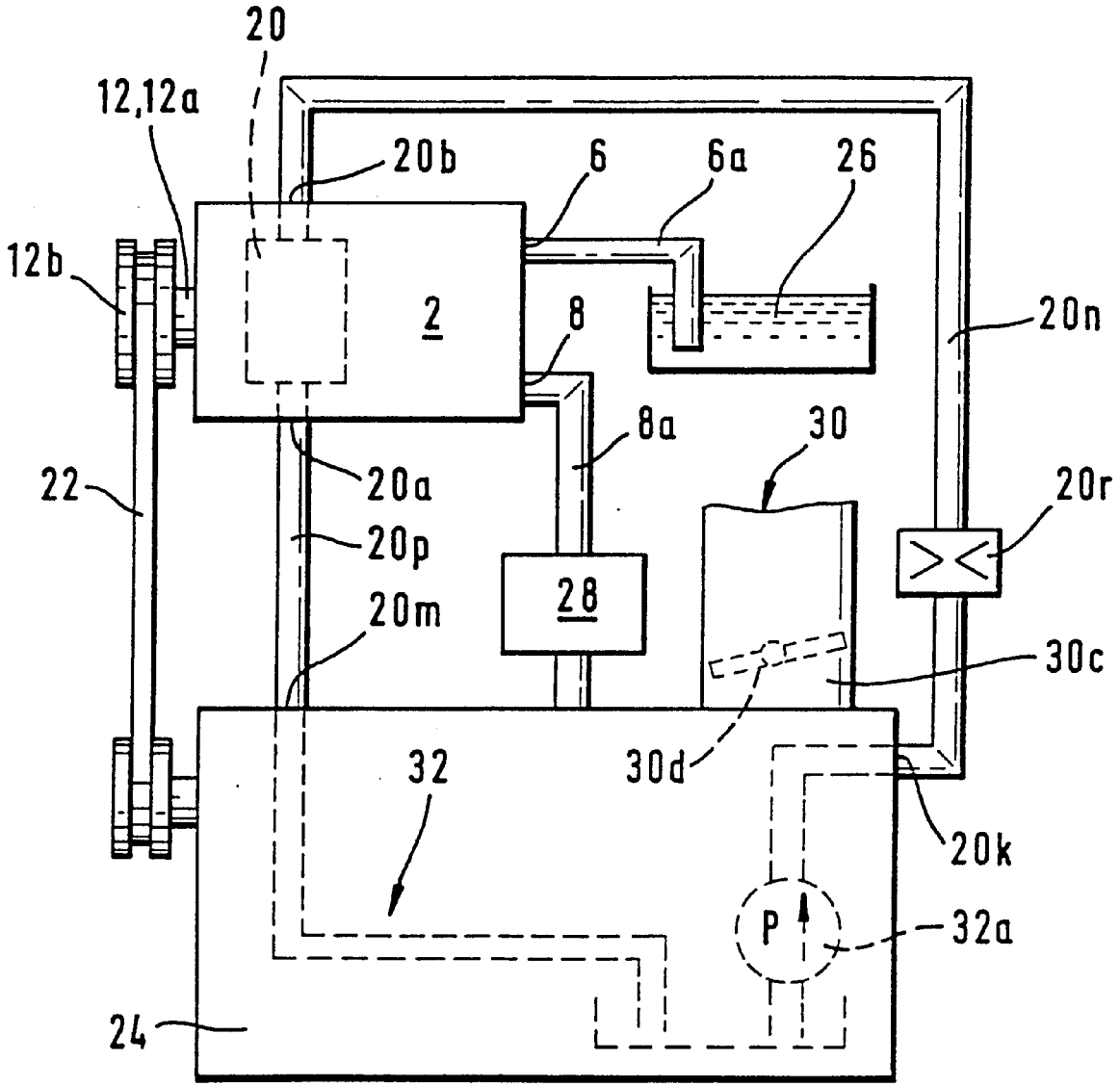

FIG. 4 schematically shows a further, preferably selected, especially advantageous exemplary embodiment.

The engine 24 has moving parts. For lubricating these parts, the engine 24 has a recirculating engine lubrication system 32 and an oil pump 32*a*. In principle, all possible engines have a recirculating engine lubrication system. In principle, an oil pump is part of the recirculating engine lubrication system.

The separation chamber 20 is connected to the recirculating engine lubrication system 32. To that end, a first oil connection 20*k* and a second oil connection 20*m* are provided on the engine 24. The first oil connection 20*k* communicates with the connection 20*b* via an oil line 20*n*. An oil line 20*p* connects the connection 20*a* with the second oil connection 20*m*. There is a throttle restriction 20*r* in the course of the oil line 20*n*.

The oil pump 32*a* of the recirculating engine lubrication system 32, provided in the engine 24 but not visible in the view shown and therefore symbolically indicated by dashed lines, pumps the oil through the engine 24 to the lubricating points provided in the engine 24. In the process, the oil also reaches the oil connection 20*k*. From the oil connection 20*k*, the oil flows through the oil line 20*n*, the throttle restriction 20*r*, the connection 20*b*, the separation chamber 20, the connection 20*a*, and the oil line 20*p* back into the engine 24 to the recirculating engine lubrication system 32. If the pressure of the oil at the oil connection 20*k* is relatively high, then the throttle restriction 20*r* must be made relatively small, so that the pressure of the oil in the separation chamber 20 will not be too high. If the oil connection 20*k* is located at a place in the recirculating engine lubrication system 32 where the oil of the recirculating engine lubrication system 32 does not have an excessively high pressure, then the throttle restriction 20*r* can be dispensed with. By way of example, the throttle restriction 20*r* may also be achieved by making the inside diameter of the oil lines 20*n* and 20*p* correspondingly small or by making the connections 20*a*, 20*b* correspondingly small. The separation chamber 20 may be connected to the main flow or via a bypass to the recirculating engine lubrication system 32.

By means of the oil pumped through the separation chamber 20 by the oil pump 32*a* of the recirculating engine lubrication system 32, the fuel that might be leaking into the separation chamber 20 from the fuel chamber 16 is entrained by oil of the recirculating engine lubrication system 32, so that no fuel can collect in the separation chamber 20. The quantity of the fuel leaking into the separation chamber 20 is so slight that no negative effects thereof on the properties of the oil in the recirculating engine lubrication system 32 need be feared.

Because of the separation chamber 20 (FIG. 1) between the fuel chamber 16 and the bearing 14, fuel is reliably prevented from being able to reach the region of the bearing 14. If the bearing seal 14*c* were acted upon directly by fuel, for instance, then the bearing seal 14*c* on its own could not always reliably prevent fuel from reaching the region of the bearing 14. As a result, the bearing 14 or parts of the bearing 14 could be damaged, and the durability of the bearing 14 could be shortened thereby. In particular, without the separation chamber 20, the bearing seal 14*c* could also be damaged by the fuel. All of this is prevented by the separation chamber 20 and by the separator means provided in the separation chamber 20. By means of the separator means, which is preferably air (FIGS. 2, 3) or oil (FIG. 4), the fuel possibly leaking out of the fuel chamber 16 into the separation chamber 20, or the fuel vapor, is taken out of the separation chamber 20 and diverted harmlessly to the engine 24 via the air inlet 30 (FIGS. 2, 3) or the oil line 20*p*. Because the fuel leaking out of the fuel chamber 16 is harmlessly diverted via the separation chamber 20, the production cost of the seal 18 and of the bearing seals 14*c* and 14*d* is reduced. The seal 18 and the bearing seals 14*c* and 14*d* can advantageously be optimized for economical manufacture and for only slight friction between the shaft 12*a* and the housing 4. Without the separation chamber 20, there would be the risk that fuel could pass via the bearing seal 14*c* into the region of the bearing 14 and via the bearing seal 14*d* to the outside between the shaft 12*a* and the housing 4. This as well as reliably prevented in a simple way by the separation chamber 20.

In the exemplary embodiment shown (FIG. 1), the shaft 12*a* is unilaterally supported. It is proposed, in the case of bilateral support of the shaft, in other words if the shaft 12*a* is supported by one bearing each on both sides of the fuel chamber 16, that one separation chamber each be provided between the fuel chamber 16 and each of the two bearings. Air or oil as a separator means is preferably located in both separation chambers. The two separation chambers can communicate with one another inside or outside the housing of the fuel pump 2.

The foregoing relates to preferred exemplary embodiments of the invention, it being understood that other variants and embodiments thereof are possible within the spirit and scope of the invention, the latter being defined by the appended claims.

We claim:

1. A fuel pump for pumping fuel for an internal combustion engine, comprising a housing, at least one fuel chamber in the housing, at least one fuel-supplying pump element that communicates with the fuel chamber, at least one drive mechanism (12) supported in the housing via at least one bearing (14), said at least one drive mechanism serving to drive the pump at least one element, at least one separation chamber (20) is provided between the fuel chamber (16) and the bearing (14), and air is present in the separation chamber (20) which is supplied at least indirectly by the engine (24).

2. A fuel pump in accordance with claim 1, in which the drive mechanism (12) includes a rotationally supported shaft **(12*a*)**.

3. A fuel pump in accordance with claim 1, in which the separation chamber (20) communicates with an air inlet (30) of the engine (24).

4. A fuel pump in accordance with claim 1, in which at least one throttle restriction **(20*i*) is disposed between the separation chamber (20) and the air inlet (30)**.

5. A fuel pump in accordance with claim 1, in which the separation chamber (20) has a first connection **(20*a*) that communicates with the air inlet (30) of the engine (24) and a second connection (20*b*)**.

6. A fuel pump in accordance with claim 5, in which at least one throttle restriction **(20*g*) is provided upstream of the separation chamber (20)**.

7. A fuel pump in accordance with claim 1, in which at least one seal (18) is provided between the fuel chamber (16) and the separation chamber (20).

8. A fuel pump in accordance with claim 1, in which at least one seal (18) is provided between the fuel chamber (16) and the separation chamber (20).

9. A fuel pump in accordance with claim 5, in which at least one seal (18) is provided between the fuel chamber (16) and the separation chamber (20).

10. A fuel pump in accordance with claim 1, in which at least one bearing seal **(14*c*) is provided between the at least one bearing (14) in the separation chamber (20)**.

* * * * *